US005560632A

United States Patent [19]

Gauer

[11] Patent Number: 5,560,632

[45] Date of Patent: Oct. 1, 1996

[54] BALLET SKI

[75] Inventor: Richard Gauer, Hewitt, N.J.

[73] Assignee: GSI, Inc., Sparta, N.J.

[21] Appl. No.: 330,263

[22] Filed: Oct. 27, 1994

[51] Int. Cl.[6] ..... A63C 15/00; A63C 5/04

[52] U.S. Cl. ..... 280/609; D21/229

[58] Field of Search ..... 280/601, 608, 280/609, 610; D21/229, 228, 230; 441/68

[56] References Cited

U.S. PATENT DOCUMENTS

| | | | |
|---|---|---|---|
| D339,398 | 9/1993 | Gauer | D21/229 |
| 3,134,992 | 1/1963 | Tyll | 441/68 |
| 3,628,804 | 12/1971 | Garreiro | 280/609 |
| 3,827,096 | 8/1974 | Brownson | 280/609 |
| 4,705,291 | 11/1987 | Gauer | 280/609 |

*Primary Examiner*—Richard M. Gamby

*Attorney, Agent, or Firm*—Anthony J. Casella; Gerald E. Hespos

[57] ABSTRACT

A ballet ski is provided for achieving enhanced stability when a skier is stationary or moving slowly. The bottom surface of the ski has a planar elliptical portion centrally under the foot of the skier. Remaining portions of the bottom surface are convex from front to rear and convex from side to side. Thus, a skier can easily roll from the planar ellipse and into the curved portion to carry out selected ballet maneuvers. Preferably, the ski is formed from separate top and bottom components configured to form air pockets that reduce the weight of the ski. The ski may also include chamfers near the rear binding to enable a brake to rotate into the snow. Additionally, hook receiving apertures may be formed through the rear end of the ski. A pair of the skis may then be used with straps having hooks engageable in the apertures for conveniently suspending the skis in a carrying position.

10 Claims, 2 Drawing Sheets

BALLET SKI

BACKGROUND OF THE INVENTION

1. Field of the Invention

The invention relates to improvements in the filed of ballet skis. The improvements relate to improved stability at low speeds, lighter weight, easier manufacturing, enhanced safety and easier transportation.

2. Description of the Prior Art

The typical prior art snow ski is very long, narrow and thin. These skis typically exhibit some flexibility along their length, but assume a reversed camber in their unflexed condition. Thus, a ski that has its bottom placed on a flat surface will be supported by the front and rear of the ski. However, portions of the ski between the front and rear will be spaced upwardly from the flat supporting surface.

Bindings are used to releasably secure ski boots to the skis. The bindings include a pressure sensitive release that will separate the boot from the ski in response to forces encountered during a fall. The release of the ski substantially reduces the possibility of leg or knee injuries. Most prior art bindings include brakes that bite into the snow when the boot is released from binding. The brakes are located adjacent the top surface of the ski and generally behind the heal of the ski boot when the ski boot is locked into the binding. Upon release of the ski boot from the binding, the brakes move laterally beyond the sides of the ski and pivot downwardly into the snow.

The length of prior art skis make them difficult to carry. Some skiers use the brakes to clamp the skis in bottom-to-bottom relationship. The interconnected skis can then be held in one hand while the skier carries additional equipment in the other hand. This interlocking of brakes can be difficult to achieve and difficult to maintain. Even a slight shifting of one ski relative to the other can cause the brakes to disengage and can make the carrying of skis cumbersome. The prior art also includes ski carriers in the form of plastic clamps that lockingly engage around a pair of skis. The clamps include a carrying handle and can greatly facilitate the carrying of prior art skis. However, the carrier must be stored while the skis are being used. Furthermore, the carrier does not avoid the inconveniences attributed to the considerable length of most prior art skis. The prior art also includes elongate flexible straps with metallic rings affixed to each end. Opposed ends of the strap can be looped through the rings, and the loops can be tightened around spaced apart locations on a pair of skis. The strap and skis then can be carried by hand or draped over the shoulder of the skier. These prior art straps are desirable in that they are inexpensive and can readily be collapsed and stored in the pocket while the skis are being used. However, the straps are not stable on the skis and the loops will eventually slide toward a central location near the bindings. Skiers have difficulty balancing the unstably suspended skis.

Very effective prior art skis are shown in U.S. Pat. No. 4,705,291 and in U.S. Pat. No. Des. 339,398 both of which issued to Richard Gauer. The skis shown in U.S. Pat. No. 4,705,291 and in U.S. Pat. No. Des. 339,398 are shorter, wider and thicker than the conventional prior art ski described above, and are substantially inflexible. The bottom surface of the skis shown in U.S. Pat. No. 4,705,291 and in U.S. Pat. No. Des. 339,398 are continuously arcuately convex from front to rear. The ski shown in U.S. Pat. No. 4,705,291 also is arcuately convex in a side-to-side direction at all locations along a centrally disposed, longitudinally extending strip of the bottom surface. However the sides of the bottom surface shown in U.S. Pat. No. 4,705,291 are substantially flat in a side-to-side direction and opposed sides are generally colinear with one another at any cross-section. The ski shown in U.S. Pat. No. Des. 339,398 does not include this side-to-side flattening near the side edges, and is continuously arcuately convex from side to side at all locations along the ski. The degree of side-to-side convexity in both of these patented skis varies along the length of the ski, such that a greater curvature exists at locations forward and aft of the foot. The skis shown in patents to Richard Gauer achieve the seemingly inconsistent objectives of providing enhanced mobility and increased control while performing various downhill ballet skiing maneuvers. These skis have enabled experienced skiers to perform beautiful artistic ballet movements while skiing down a steep slope, and also have enabled novice skiers, elderly skiers and handicapped skiers to effortlessly perform basic downhill skiing maneuvers. The skis shown in the patents to Richard Gauer are marketed under the trademark GAUER.

Despite the many advantages of the skies shown in U.S. Pat. No. 4,705,291 and U.S. Pat. No. Des. 339,398, improvements can still be made. For example, the side-to-side convexity at all locations along the length of the GAUER brand of ski can make skiers feel unstable when skiing slowly on packed snow or when standing stationary on packed snow. This may occur, for example, when the skier is moving into or through a ski lift line or when a skier is exiting a chair lift. At these locations, the snow is likely to be densely packed, and the skier may be standing substantially erect with weight balanced centrally over the skis while moving very slowly or standing still. Under these conditions, a novice skier may perceive a loss of balance in response to a shift of weight.

The prior art GAUER brand skis also are considered to be heavy for their size. In this regard, the hollow foam-filled embodiments formed from two lateral channels as depicted in U.S. Pat. No. 4,705,291 have been difficult to commercialize. Rather, the unitary injection molded ski depicted in the design patent has proved more commercially feasible. However, in view of the significant thickness, the unitarily molded ski is fairly heavy (3.5 pounds each ski without bindings) and requires a fairly long injection molding cycle time.

The width and thicknesses of the GAUER brand of skis also have made use prior art brakes difficult. In particular, prior art brakes will rotate into the top surface of the GAUER brand ski before moving laterally beyond the sides of the ski. Attempts have been made to bend the brakes outwardly into positions that will permit them to rotate fully. However, these revisions to the prior art brakes cause the brakes to project laterally even while the boots are in the bindings. Thus, a skier can readily catch one boot or ski on the inside brake of the opposed ski. Furthermore, the outwardly bent brakes do not dig deeply into the snow, and hence braking effectiveness is reduced.

The shorter length of the GAUER brand of skis intuitively should lead to easier carrying. However, the greater width and thickness makes it difficult to manually grasp these skis. Additionally, the prior art plastic carrying clamps are not dimensionally suited to the prior art GAUER brand of skis. The prior art straps described above can be used with GAUER brand of skis. However, these prior art straps have certain deficiencies as noted above. Additionally, the significant width and thickness dimensions of GAUER brand of skis make the looping required by the prior art straps even more difficult. Furthermore, these skis inherently leave little room aft of the bindings. Hence, there is only a very short space on the prior art GAUER brand skis that can be engaged by the loop of the prior art strap.

Water skis bear some resemblance to snow skis, but are subject to significantly different forces during use. Nevertheless, the water ski shown in U.S. Pat. No. 3,134,992 has a bottom surface which, at all locations along the ski is curved from front to rear and flat from side-to-side. The ski also includes plane surfaces around the bottom periphery to define a dihedral at the intersections with the flat bottom surface. The continuous front to rear curvature would not yield enhanced stability for a stationary or slow moving skier on snow. Furthermore, the bottom surface that is flat from side-to-side at all locations and the plane surfaces around the bottom periphery would not permit smooth flowing ballet movement on snow.

SUMMARY OF THE INVENTION

The subject invention is directed to an improved ballet ski. The ski is substantially rigid and includes opposed front and rear ends, a top surface, a bottom surface and a pair of longitudinally extending sides. The ski preferably is formed from plastic material. However, metallic edges are securely affixed to the bottom surface of the ski adjacent the respective sides.

The bottom surface of the ski is characterized by a substantially planar region that is approximately symmetrical with the pivot point. The pivot point is the location on the top surface of the ski about which the bindings are centered. The planar region on the bottom surface preferably is generally elliptical in shape, and may have a major axis aligned with the longitudinal axis of the ski. The planar region on the bottom surface of the ski preferably extends longitudinally a distance less than the length of the typical ski boot used with the ski. A preferred length for the planar region is approximately 6–10 inches. Regions of the bottom surface forwardly and rearwardly of the planar region are continuously arcuately convex from front to rear to achieve effective and efficient maneuverability with the ski.

The planar region on the bottom surface of the ski further includes a width extending transverse to the longitudinal axis of the ski. The width of the planar region is less than the width of the ski. Portions of the bottom surface on either side of the planar region are convex from side-to-side. Furthermore, these portions of the bottom surface on either side of the planar region are continuously arcuately convex from front to rear. Portions of the bottom surface forwardly and rearwardly of the planar region are continuously convex from side to side. The degree of side-to-side convexity is greatest at locations on the bottom surface forward of the planar region.

The symmetrically disposed planar region on the bottom surface of the ski achieves stability when a skier is standing still or moving slowly, and is particularly effective on densely packed snow. Thus, the planar region contributes to a sense of security when a skier is stopped in a ski lift line, when the skier makes an initial movement from a stopped position in a ski lift line, or when the skier is performing slow basic skiing movements. This slow skiing may be carried out when the skier is on the densely packed snow at the bottom of the slope or when the skier has exited a chair lift and is approaching the start of a downhill slope. However, the side-to-side convexity that exists between the planar region and the side edges of the ski ensures that the skier has superior maneuverability during normal skiing. Furthermore, the side-to-side convexity covers a longer distance at both the forward and rearward ends of the planar surface. The greater width of the side-to-side convex region at the forward end of the planar area enables the skier to roll the bottom surface of the skis efficiently into a turn, while the comparably greater width of the side-to-side convex region at the rear end of the planar area enables the skier to efficiently roll the bottom surface of the ski out of a turn. Throughout all such turns, the metallic side edges of each ski are effective in gripping snow or ice to provide exceptional control. Thus, the unique bottom surface of the ski ensures stability when the skier is stationary or moving slowly and provides controllable maneuverability at all other times.

The ski may be formed from interconnected top and bottom components. The top and bottom components may respectively include longitudinally extending interfitting ribs to achieve proper and permanent alignment between the top and bottom components and to ensure adequate rigidity in all directions. The ribs on the top and/or bottom component may be dimensioned to leave a plurality of longitudinally extending air chambers for reducing the weight of each ski. However, the ribs preferably are disposed and dimensioned to ensure an adequate amount of plastic for anchoring the metallic edges of the ski and for mounting the bindings. The top and bottom components of each ski may be mechanically interconnected with one another. However, a preferred interconnection employs sonic welding to integrally attach the top and bottom components to one another at selected locations where the top and bottom components contact.

The ski may include locally chamfered regions at the interface of the top surface and the sides to accommodate movement of brakes on the bindings. The chamfers permit the brakes to pivot downwardly as they are translating laterally and into a braking disposition. Similarly, the chamfers permit the brakes to efficiently rotate upwardly and to translate inwardly as the boot is being engaged into the bindings. These chamfers avoid the need to deform the brakes, and hence ensure that the brakes are positioned to avoid contact with the opposing ski or boot during normal skiing.

Each ski preferably includes a transversely aligned slot extending entirely therethrough at a location near the extreme rear end of the ski. The skis may further be used in conjunction with a strap having hooks attached to opposed ends. The hooks are releasably engageable in the slots of the skis to permit convenient carrying of the skis.

DETAILED DESCRIPTION OF THE PREFERRED EMBODIMENT

Figure 2:
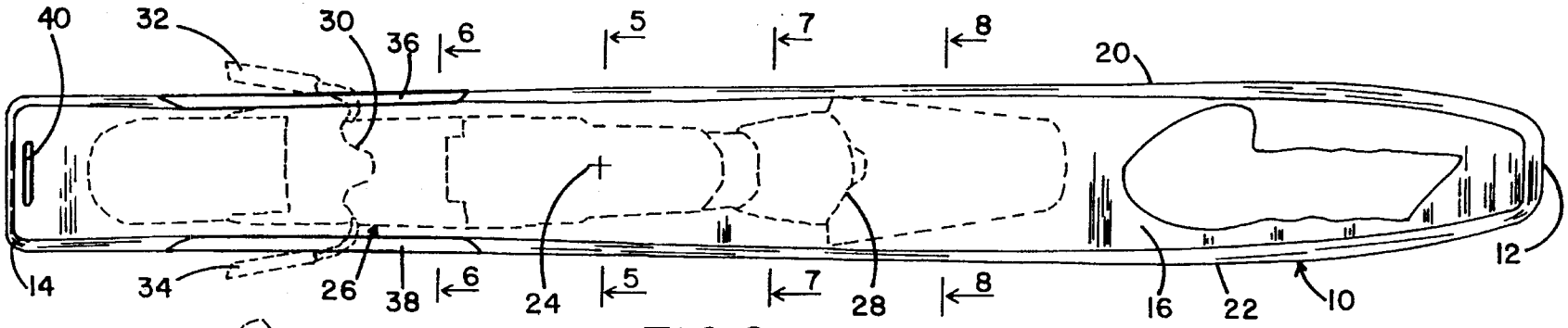
FIG. 2 is a top plan view of a ski in accordance with the subject invention.
Figure 3:
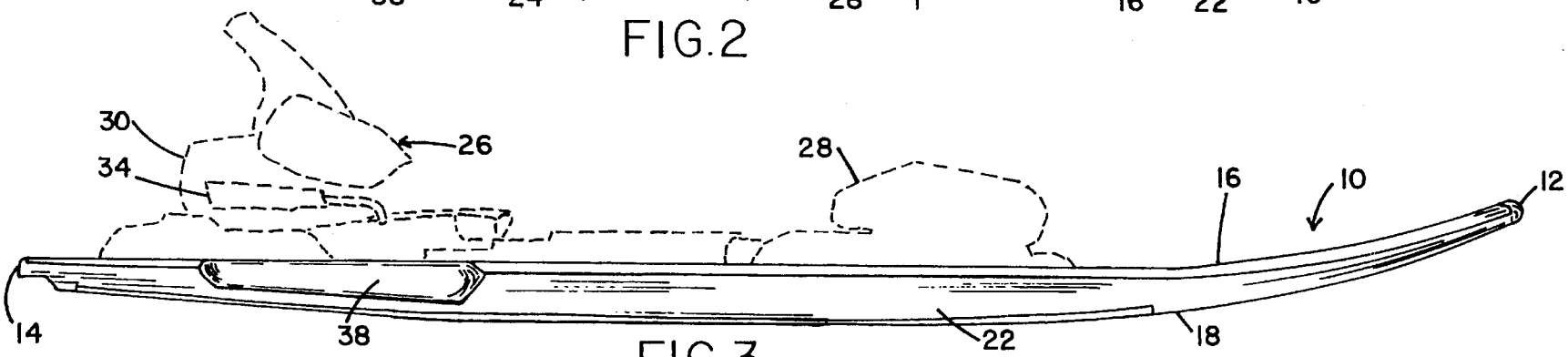
FIG. 3 is a side elevational view of the ski.
Figure 4:
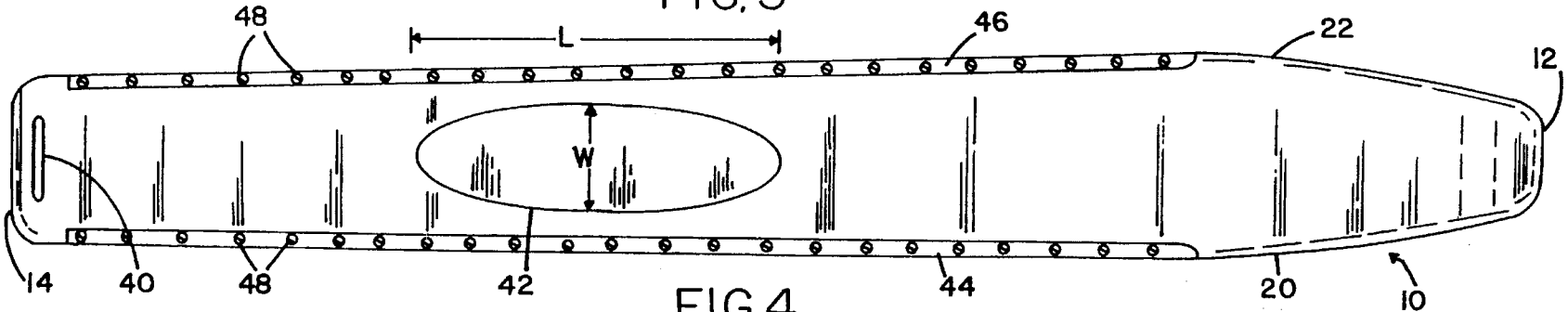
FIG. 4 is a bottom plan view of the ski.

Skis in accordance with the subject invention are identified generally by the numeral 10 in FIGS. 1–8. With reference to FIGS. 2–4, each ski 10 includes opposed front and rear ends 12 and 14 respectively, opposed top and bottom surfaces 16 and 18 respectively and opposed sides 20 and 22.

The top surface 16 of the ski 10 includes indicia for identifying the point 24 about which the bindings and ski boots are centered. This centering point is common in prior art skis as well. A set of prior art bindings 26 is securely mounted to top surface 16 of ski 10 at a location appropriately centered on the centering point 24. The bindings 26 includes a front binding 28 and a rear binding 30.

The rear binding 30 is equipped with a pair of brakes 32 and 34 respectively. The brakes 32 and 34 are driven by the rear binding 30 from a braking position as illustrated in FIG. 2 to a skiing position as illustrated in FIG. 3. In the skiing position of FIG. 3, the brakes 32 and 34 are rotated upwardly and are retracted inwardly to lie substantially entirely above top surface 16 and between sides 20 and 22. Upon release of a ski boot from the rear binding 30, the brakes 32 and 34 will translate laterally away from one another, and will simultaneously rotate downwardly so that portions of each brake 32 and 34 will lie below the bottom surface 18 of the ski 10. This translational and pivoting movement of each brake 32 and 34 is accommodated by a pair of chamfers 36 and 38 formed in each ski 10. The chamfers 36 and 38 lie at the interface of the top surface 16 with the respective sides 20 and 22 of the ski 10. Furthermore, the chamfers 36 and 38 are disposed rearwardly of centering point 24 and generally aligned with the rear binding 30. The chamfers 36 and 38 are configured and aligned to permit free rotation of the brakes 32 and 34 from the FIG. 3 skiing position to the FIG. 2 braking position and vice versa.

The ski 10 is characterized by an aperture 40 extending entirely therethrough from the top surface 16 to the bottom surface 18 at a location near the rear end 14 of the ski 10. The apertures 40 enable a pair of skis 10 to be used with a carrying strap 82 as illustrated schematically in FIG. 1. More particularly, the carrying strap 82 includes end hooks 84 and 86 which are dimensioned to releasably engage in the aperture 40 of a ski. Thus, the strap 82 and the skis 10 mounted thereon can be suspended around the neck or over the shoulder of a skier for convenient transportation. This convenience is enabled by the desirably short length (e.g., 80–100 cm) of the ski 10.

The bottom surface 18 of the ski 10 is characterized by a substantially elliptically shaped planar portion 42. The planar elliptical portion 42 has a major axis of symmetry aligned substantially parallel to the longitudinal axis of the ski 10 and defining a length "L" which is less than the length of a typical ski boot to be mounted on the top surface 16 of the ski 10. More particularly, a preferred length "L" for the planar ellipse 42 is approximately eight inches. The planar elliptical portion 42 also has a minor axis of symmetry which intersects the major axis of symmetry at a location approximately registered with the centering point 24 shown in FIG. 2. The minor axis of symmetry defines a width "W" for the planar ellipse 42 approximately equal to 60°–75° of the overall width of the ski at that location. In a preferred embodiment, the planar ellipse 42 defines a width "W" approximately equal to 2.5 inches, while the ski defines an overall width at that location of centering point 24 approximately 3.5 inches.

Figure 1:
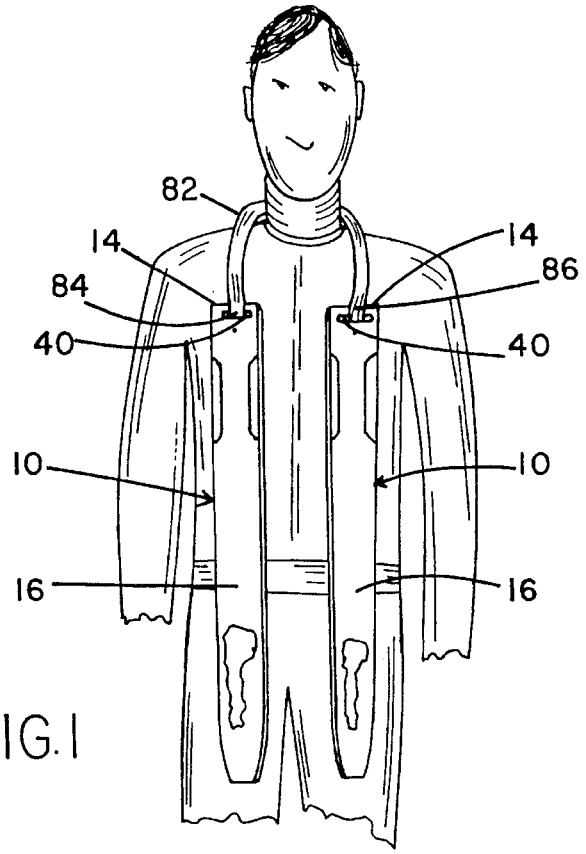
FIG. 1 is a schematic view of a pair of skis in accordance with the subject invention suspended from a carrying strap and being carried by a skier.
Figure 5:
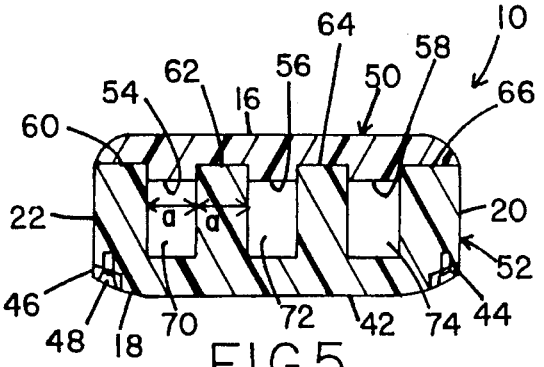
FIG. 5 is a cross-sectional view taken along line 5—5 in FIG. 2.
Figure 7:
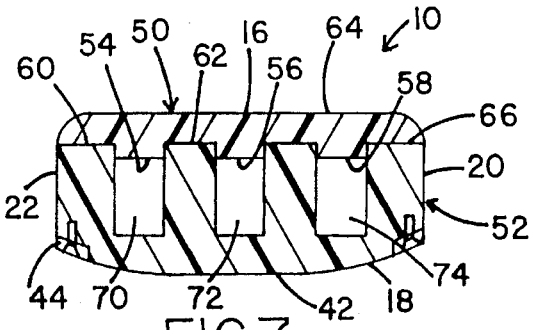
FIG. 7 is a cross-sectional view taken along line 7—7 in FIG. 2.
Figure 6:
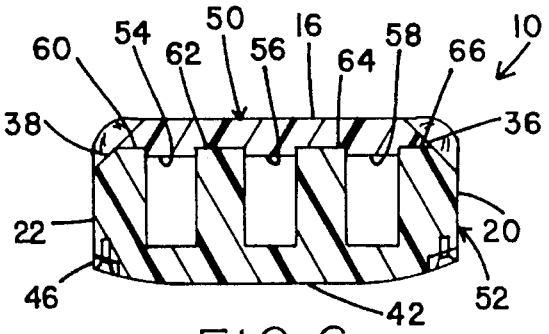
FIG. 6 is a cross-sectional view taken along line 6—6 in FIG. 2.

As shown in FIG. 3, the bottom surface 18 of the ski 10 in continuously arcuately convex from front to rear at locations disposed both forwardly and rearwardly of the planar ellipse 42. Additionally the bottom surface 18 is continuously arcuately convex from front to rear locations on either side of the planar ellipse 42. As shown in FIGS. 4–6, portions of the bottom surface 18 on either side of the planar ellipse 42 extend convexly upwardly. The side-to-side dimensions of these convex regions on either side of the planar ellipse 42 are shortest at the locations aligned with minor axis of symmetry, as shown in FIGS. 4 and 5. The width of the planar ellipse 42 decreases both forwardly and rearwardly from the minor axis of symmetry. As a result, the side-to-side dimension of these convex regions near the forward or rearward ends of the planar ellipse 42 become increasingly greater.

Figure 8:
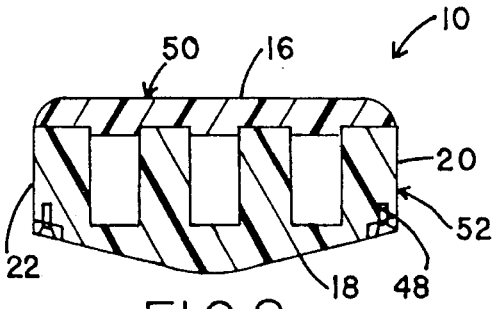
FIG. 8 is a cross-sectional view taken along line 8—8 in FIG. 2.

As shown in FIG. 8, the side-to-side convexity at locations forwardly of the planar ellipse 42 is defined by a smaller radius of curvature portion disposed in a central location on the bottom surface 18 and extending through a width of approximately 25%–40%, and preferably 33%, the width of the ski 10. The sides of the bottom surface 18 extend laterally and upwardly as tangents to the curved central portion at locations forward of the planar ellipse. The bottom surface 18 has its greatest side-to-side convexity at the location shown in FIG. 8. The side-to-side convexity rearward of the planar ellipse 42 includes a central curved portion and tangents extending laterally therefrom similar to FIG. 8. However the curved central portion to slightly flatter than in FIG. 8, and hence the degree of side-to-side convexity is less. The side-to-side convexity also flattens out somewhat at the extreme forward end of the ski 10.

As depicted clearly in each of FIGS. 4–7, the bottom surface of the ski 18 is characterized by well defined metallic side edges extending substantially the entire length thereof. The metallic edges 44 and 46 define widths of approximately ¼–½ inch The metallic edges 44 and 46 are securely held in position by a plurality of screws 48 extending upwardly for secure anchoring into the ski. The edges have side-to-side alignments substantially tangent to the side-to-side convexity of the bottom surface 18 at all locations therealong. Thus, the bottom surface of the ski can efficiently and smoothly roll into one of the metallic side edges 44 or 46 as the skier is turning. However, the extreme corner defined by each edge, as shown in FIGS. 5–8, enables the skier to exercise exceptional control during such turns. As shown most clearly in FIGS. 4–7, the planar ellipse 42 is, at all locations, spaced inwardly from metallic edges 44 and 46.

The bottom surface configuration depicted in FIGS. 4–7 yields several performance advantages. First, the planar ellipse 42 provides a sufficiently large platform to give stability to even a novice or elderly skier while standing still, commencing short movements from a standstill, or moving slowly. These movements are likely to occur after a skier finishes a downhill run, as a skier is standing in or moving through a ski lift line or when the skier is moving slowly after leaving a chair lift and preparing to commence a downhill run. The stability enabled by the planar ellipse 42, however, does not affect downhill skiing performance in any measurable way. In particular, the planar ellipse 42 is spaced inwardly from the sides 20 and 22 of the ski and from the metallic edges 44 and 46. Hence, even at the widest portion of planar ellipse 42, the skier can still rock onto the side-to-side convex portions between the planar ellipse 42 and the sides 20 and 22 of the ski. Furthermore, the skier typically will rock onto portions forwardly or rearwardly of the planar ellipse 40 and 42 while negotiating turns during downhill skiing. The width of the planar ellipse 42 becomes narrower at such forward and rearward locations, with the side-to-side convexity occupying greater dimensions on the ski. Hence, the skier can easily rock onto these wider side-to-side convex portions during a skiing maneuver. Furthermore, as shown in FIG. 8, the ski exhibits continuous side-to-side convexity at locations forwardly and rearwardly of the planar ellipse 42. Weight is shifted toward these locations during skiing, and hence turns and spins can be completed easily with the ski 10. The slightly flatter convexity at the rear end helps prevent uncontrolled spinout at the end of a turn.

As shown in FIGS. 5–8, the ski 10 is formed from opposed top and bottom components 50 and 52. The top component 50 includes a plurality of spaced apart substantially parallel longitudinally extending ribs 54, 56 and 58 disposed at locations spaced inwardly from the longitudinal sides 20 and 22 of the ski. Each rib 54, 56 and 58 defines a width "a" as shown in FIG. 6, and the ribs 54, 56 and 58 are spaced from one another by distances "a". Additionally, the ribs 54 and 58 are spaced inwardly from the sides 20 and 22 of ski 10 by distance "a". The ribs 54, 56 and 58 extend from the top surface 16 of ski 10 by distance "b". Portions of the top component 50 between adjacent ribs 54, 56 and 58 define a thickness "c" which preferably equals no more than one quarter inch.

The bottom component 52 of the ski 10 includes parallel spaced apart ribs 60, 62, 64 and 66. Each of the ribs 60–66 defines a width "a" which is equal to the spacing between the ribs 54–58 of the top component 50. Additionally, the spacing between the ribs 60–66 of the bottom component 52 also equals dimension "a". With this construction, the ribs 54–58 can be interdigitated with the ribs 60–66 on the bottom component 52. The ribs 60–66 define greater heights than the ribs 54–58 on the top component 50. Thus, the ribs 60–66 of the bottom component 52 will extend into abutting engagement with portions of the top component 50 intermediate ribs 54–58. Conversely, the ribs 54–58 of the top component 50 will not extend entirely into abutting face-to-face engagement with the deepest portion of the bottom component 52 between ribs 60–66 respectively. As a result, as shown in each of FIGS. 5–8, longitudinally extending air channels 70, 72 and 74 are defined within the ski. The channels function to significantly reduce the weight of the ski 10 without significantly affecting the strength. Additionally, by positioning the rib 60 and 66 of the bottom component 52 adjacent the extreme sides 20 and 22 of the ski 10, there exists sufficient plastic material for anchoring the screws 48 of the metallic edges 40 and 46. In addition to reducing the weight of the ski 10, the two piece construction depicted in FIGS. 5–8 enables a very substantial reduction in plastic molding time by reducing the thickness of plastic that must be cooled. The top and bottom components may be sonically welded.

While the invention has been described with respect to a preferred embodiment, it is apparent that various changes can be made without departing from the scope of the invention. For example, the planar ellipse on the bottom surface of the ski and the two piece construction of the ski can be provided independently of one another.

I claim:

1. An elongate substantially rigid ski having opposed front and rear ends, opposed sides, a top surface and a bottom surface, said bottom surface including metallic edges adjacent said sides, said bottom surface including an elliptically shaped planar portion intermediate said metallic edges, said bottom surface further being convex from front to rear at all locations spaced from planar portion and being convex from side-to-side at all locations spaced from said planar portion.

2. The ski of claim 1, wherein said elliptically shaped planar portion has a center, said ski further comprising bindings mounted on said top surface, said bindings being centered about a point registered with the center of said elliptically shaped planar portion on said bottom surface.

3. The ski of claim 2, further comprising chamfers extending from said top surface to said side surfaces for accommodating brakes on said bindings.

4. The ski of claim 1, wherein said elliptically shaped planar portion on said bottom surface is spaced inwardly from said sides of said ski by at least approximately one-half inch.

5. The ski of claim 4, wherein said elliptically shaped planar portion of said bottom surface is symmetrically disposed intermediate said sides of said ski.

6. The ski of claim 1, wherein said elliptically shaped planar portion defines a non-circular ellipse having a major axis aligned longitudinally on said ski.

7. The ski of claim 6, wherein the major axis of said elliptically shaped planar portion is between six inches and ten inches long.

8. The ski of claim 7, wherein the major axis of said elliptically shaped planar portion is approximately eight inches long.

9. The ski of claim 1, wherein portions of said bottom surface forward of said planar portion include a side-to-side arcuately convex area spaced inwardly from said sides of said ski, areas of said bottom surface forward of said planar portion and adjacent said sides being tangent to said side-to-side arcuately convex area.

10. The ski of claim 9, wherein said side to side arcuately convex area is approximately 25%–40% as wide as said ski.

* * * * *